US005687794A

United States Patent [19]

Watkins et al.

[11] Patent Number: 5,687,794

[45] Date of Patent: Nov. 18, 1997

[54] SUBSEA WELLHEAD APPARATUS

[75] Inventors: Bruce J. Watkins, Houston; Larry E. Reimert, Spring, both of Tex.

[73] Assignee: Dril-Quip, Inc.

[21] Appl. No.: 584,879

[22] Filed: Jan. 11, 1996

Related U.S. Application Data

[63] Continuation-in-part of Ser. No. 273,407, Jul. 11, 1994, abandoned.

[51] Int. Cl.[6] ..... E21B 33/043

[52] U.S. Cl. ..... 166/363; 166/368

[58] Field of Search ..... 166/335, 340, 166/344, 363, 364, 365, 368

[56] References Cited

U.S. PATENT DOCUMENTS

| | | | |
|---|---|---|---|
| Re. 31,645 | 8/1984 | Regan | 166/340 |
| 3,360,048 | 12/1967 | Watkins . | |
| 4,125,155 | 11/1978 | Brock, Jr. | 166/97 |
| 4,333,526 | 6/1982 | Watkins | 166/87 |
| 4,449,583 | 5/1984 | Lawson | 166/321 X |
| 4,658,904 | 4/1987 | Doremus et al. | 166/336 |
| 4,784,225 | 11/1988 | Petersen | 166/373 |
| 4,807,700 | 2/1989 | Wilkins | 166/86 |
| 4,848,457 | 7/1989 | Lilley | 166/87 |
| 4,869,318 | 9/1989 | Kellett | 166/87 |
| 4,887,672 | 12/1989 | Hynes | 166/344 |
| 4,903,774 | 2/1990 | Dykes et al. | 166/363 |
| 4,958,686 | 9/1990 | Putch | 166/348 |
| 5,040,606 | 8/1991 | Hopper | 166/332 |
| 5,044,432 | 9/1991 | Cunningham et al. | 166/87 |
| 5,143,158 | 9/1992 | Watkins et al. | 166/344 |

FOREIGN PATENT DOCUMENTS

| | | |
|---|---|---|
| 0349685 | 2/1992 | European Pat. Off. . |
| 2049765 | 12/1980 | United Kingdom . |
| 2214543 | 9/1989 | United Kingdom . |
| 2218135 | 11/1989 | United Kingdom . |
| 2243383 | 10/1991 | United Kingdom . |
| 2275952 | 9/1994 | United Kingdom . |
| 2287263 | 9/1995 | United Kingdom . |

*Primary Examiner*—William P. Neuder

*Attorney, Agent, or Firm*—Vaden, Eickenroht, Thompson, LLP

[57] ABSTRACT

There are disclosed two embodiments of subsea wellhead apparatus each of which includes a subsea wellhead housing installed at the ocean floor, a casing hanger connectable to the to the upper end of a casing string and supported in the bore of the housing to suspend the casing string in the well bore, and a tubing hanger connectable to the upper end of a tubing string and also supported within the housing bore above the casing hanger for suspending the tubing string within the casing string. A primary valve and a secondary backup valve are installed in series for controlling a passageway in the tubing hanger, and during the completion process, with an additional passageway in a Christmas tree which is installed on the head above the tubing hanger.

24 Claims, 12 Drawing Sheets

SUBSEA WELLHEAD APPARATUS

This application is a continuation-in-part of our application, Ser. No. 08/273,407, filed Jul. 11, 1994, now abandoned, and entitled "SUBSEA WELLHEAD APPARATUS".

This invention relates generally to subsea wellhead apparatus which includes, among other things, a subsea wellhead housing installed at the ocean floor, a casing hanger connectable to the upper end of a casing string and supported in the bore of the housing to suspend the casing string in the well bore, and a tubing hanger connectable to the upper end of a tubing string and also supported within the housing bore above the casing hanger for suspending the tubing string within the casing string. More particularly, it relates to improvements in such apparatus which includes first valve controlled passageway means in the tubing hanger which connects the annulus between the casing and tubing strings with the bore of the housing above the tubing hanger and thus with second passageway means in a Christmas tree which is installed on the head above the tubing hanger.

During the completion of an offshore well, the casing and tubing hangers are lowered into supported positions within the wellhead housing through a blowout preventer (BOP) stack installed above the housing. Following completion of the well, the BOP stack is replaced by a Christmas tree having suitable valves for controlling the production of well fluids. The casing hanger is sealed off with respect to the housing bore and the tubing hanger is sealed off with respect to the casing hanger or the housing bore, so as to effectively form a fluid barrier between the annulus between the casing and tubing strings and the bore of the housing above the tubing hanger. However, during completion of the well as well as following completion of the well, there may be reasons to communicate between the annulus and Christmas tree and thus permit fluid circulation between them. Hence, it has been proposed to provide the tubing hanger with valves (known as "annulus valves") for controlling flow through passageway means in the tubing hanger connecting the annulus and bore, whereby the passageway means may be closed and well fluid contained at least during those intervals in which the BOP stack or Christmas tree is removed.

U.S. Pat. No. 5,143,158, assigned to the assignee of the present application, relates to wellhead equipment including a tubing hanger having an annulus valve which is an improvement in many respects over prior valves of this general type. Like any other valve, however, this annulus valve is susceptible of failure for various reasons, such as malfunction of the operating system for shifting the valve member between alternate positions, leakage of one or more seal rings, etc. The inability to close such a valve in this particular environment could be catastrophic because there is no way to repair or replace it without removing the tree and penetrating the tubing hanger to obtain access to it, all of which would result in loss of the fluid pressure barrier across the hanger. Hence, it is the object of this invention to provide wellhead equipment which is so constructed and arranged as to overcome this and other problems with prior equipment and valves of this type, and, more particularly, which provides a means by which flow through the passageway means may be easily and quickly shut off in these or other situations without having to penetrate the tubing hanger.

This and other objects are accomplished, in accordance with the illustrated embodiment of the invention, by a subsea wellhead, which includes a wellhead housing, a casing hanger, and a tubing hanger supported within the bore of the housing as above described, and, during the completion process, a Christmas tree removably mounted on the housing above the upper end of the tubing hanger and having second passageway means forming a continuation of the upper end of the passageway means in the tubing hanger, to connect with the annulus between the suspended casing and tubing strings beneath the tubing hanger with the bore of the housing above the tubing hanger. As in prior apparatus of this type, a primary valve having a valve member is installed in the first passageway means, and a means is provided for selectively moving said first valve member between opened and closed position, in response to a remote source of pressure fluid supplied preferably through the Christmas tree. This valve may be, but is not necessarily, made in accordance with the aforementioned U.S. Pat. No. 5,143,158.

However, in accordance with the novel aspects of this invention, a second backup valve including a second valve member is also installed in the first passageway means in series with the first valve member, and a means is provided for moving the second valve member from a normally open to a closed position independently of operation of the first valve member, whereby, the first passageway means may be closed, when, for example, the first described valve malfunctions, and the tree replaced by BOP stock so that necessary repairs may be made. Preferably the means for so moving the second valve member includes means which is responsive to a second remote source of fluid under pressure, preferably supplied through the Christmas tree.

In the illustrated and preferred embodiments of the invention, the first passageway includes an elongate cavity having a closed end, a side inlet and a side outlet, and the second valve member includes a spool which is sealably shiftable longitudinally within the cavity between open and closed positions respectively connecting and disconnecting the inlet and outlet, the spool having a hole through it to balance forces across it due to fluid pressure on its opposite ends.

Still further, the second valve member has a stem extending through one end of the cavity, and a piston is reciprocable in a cylinder in the Christmas tree for receiving fluid pressure from the above mentioned remote source of pressure fluid to urge it against the stem and thus move second valve member to closed position. In accordance with one embodiment of the invention, the stem has means thereon which may be grasped from above the tubing hanger, upon removal of the BOP, in order to move the second valve member back to open position. In another embodiment, a piston having a seal may thereabout reciprocable in the cavity intermediate its closed end and the spool, and means for selectively supplying fluid pressure from a remote source cavity intermediate the seal ring and closed end of the cavity to move the second valve member from closed to open position, and venting said fluid pressure from the cavity to permit the second valve member to be moved from opened to closed position.

In the drawings, wherein like reference characters are used throughout to designate like parts:

FIGS. 1 and 2 are vertical sectional views of respectively upper and lower portions of a subsea wellhead constructed in accordance with one embodiment of the present invention, and showing the valve member of the first or main valve as well as the valve member of the second or shutoff valve in their open positions to permit flow through the passageway means in the tubing hanger connecting the annulus between the casing and tubing strings with the upper end of the tubing hanger and thus with additional passageway means in the Christmas tree installed on the wellhead above the tubing hanger;

FIGS. 3 and 4 are similar views of the upper and lower portions, respectively, of the wellhead apparatus FIGS. 1 and 2, but with the pistons in the tree shown in a rotationally oriented position and lowered to move the valve member of the shutoff valve to its position closing the passageway means through the tubing hanger;

FIG. 5 is a cross-sectional view of a lower portion of the tubing hanger, as seen along broken lines 5—5 of FIG. 2, and showing the lowermost passageway section connecting the lower end of the tubing hanger with the lower end of the cavity in which the valve member of the primary valve reciprocates, and a lateral port connecting the lowermost section with a vertical passageway section intermediate the valve members;

Figure 1:
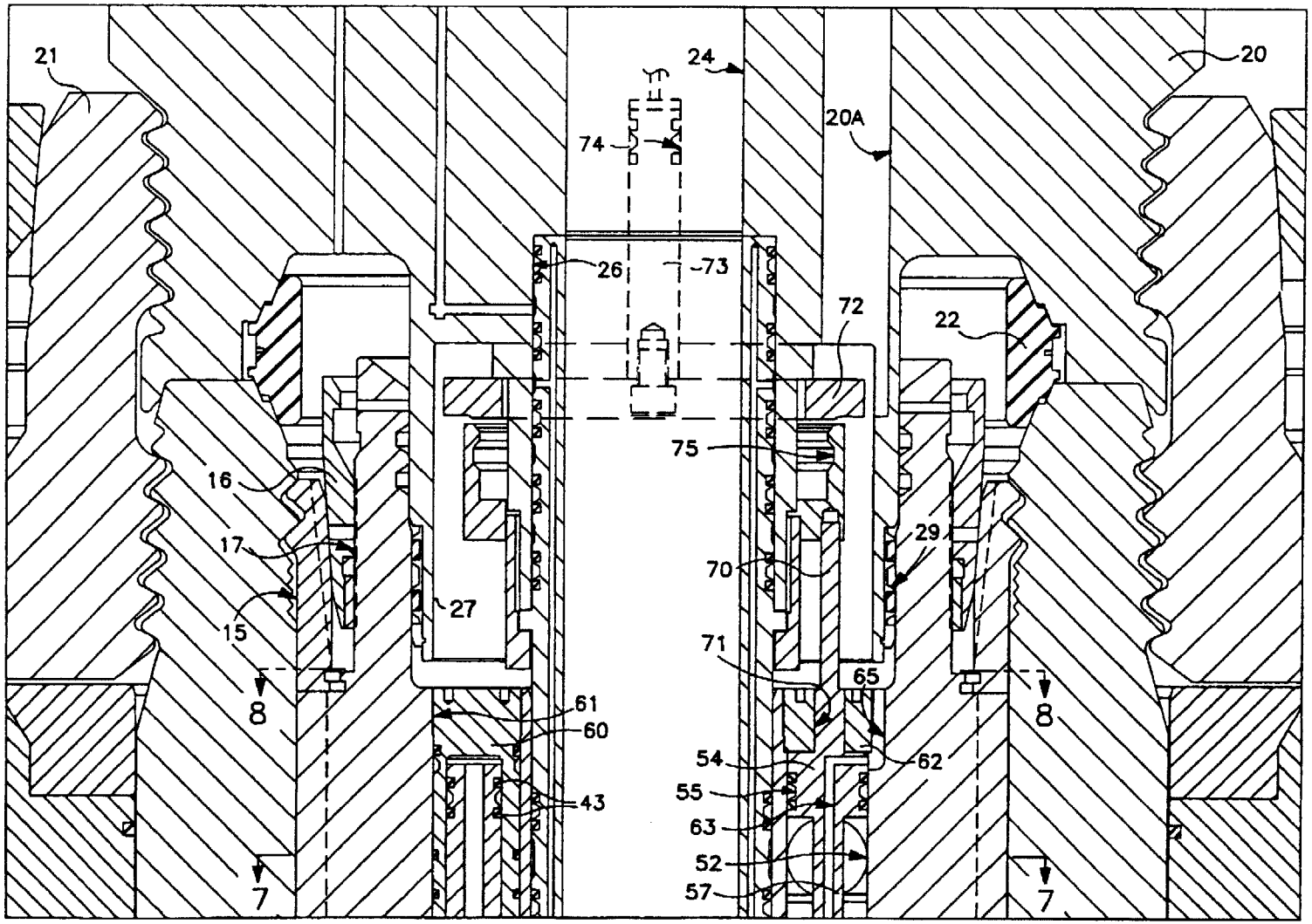
Figure 2:
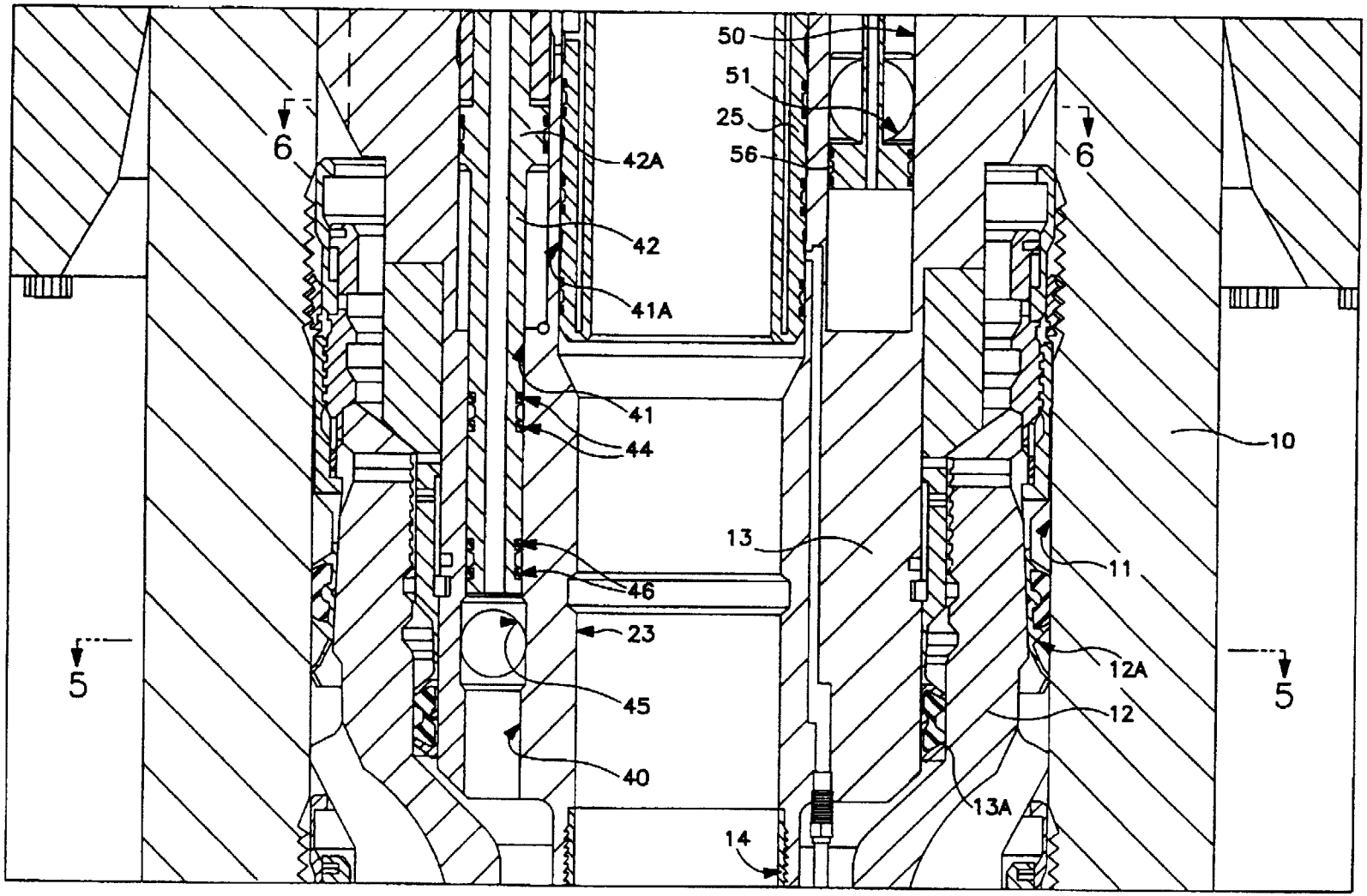
Figure 8:
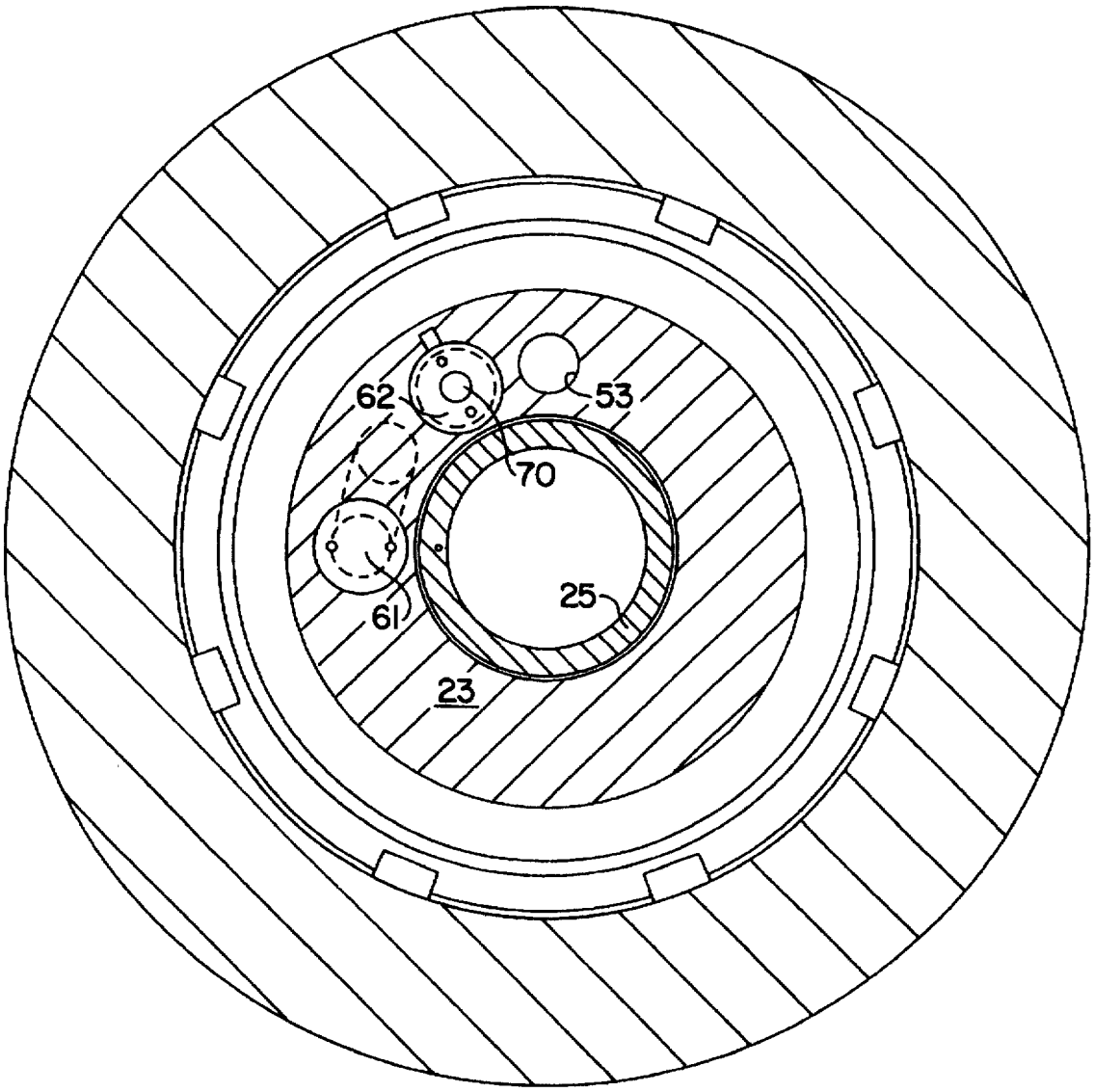
Figure 9:
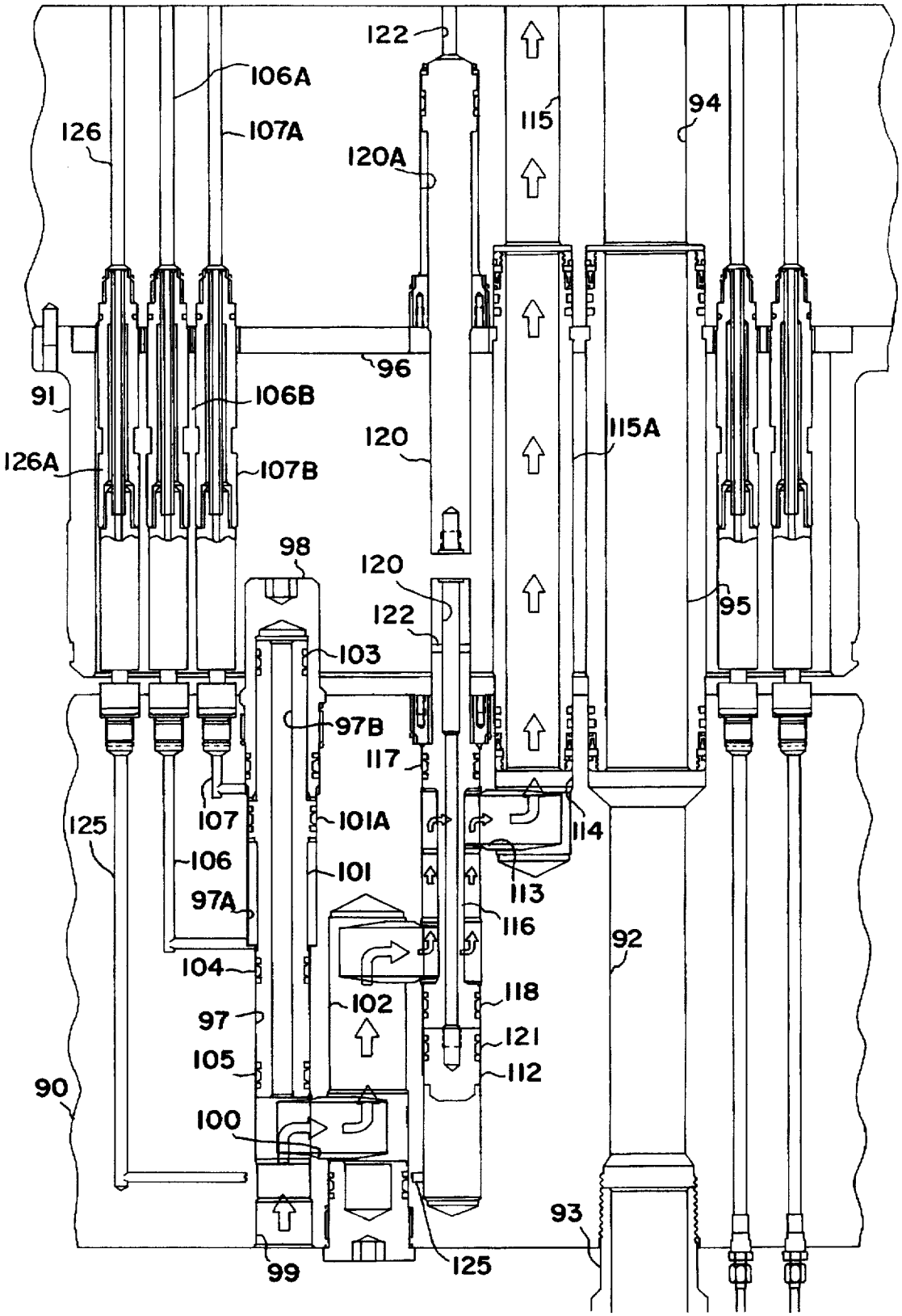
Figure 10:
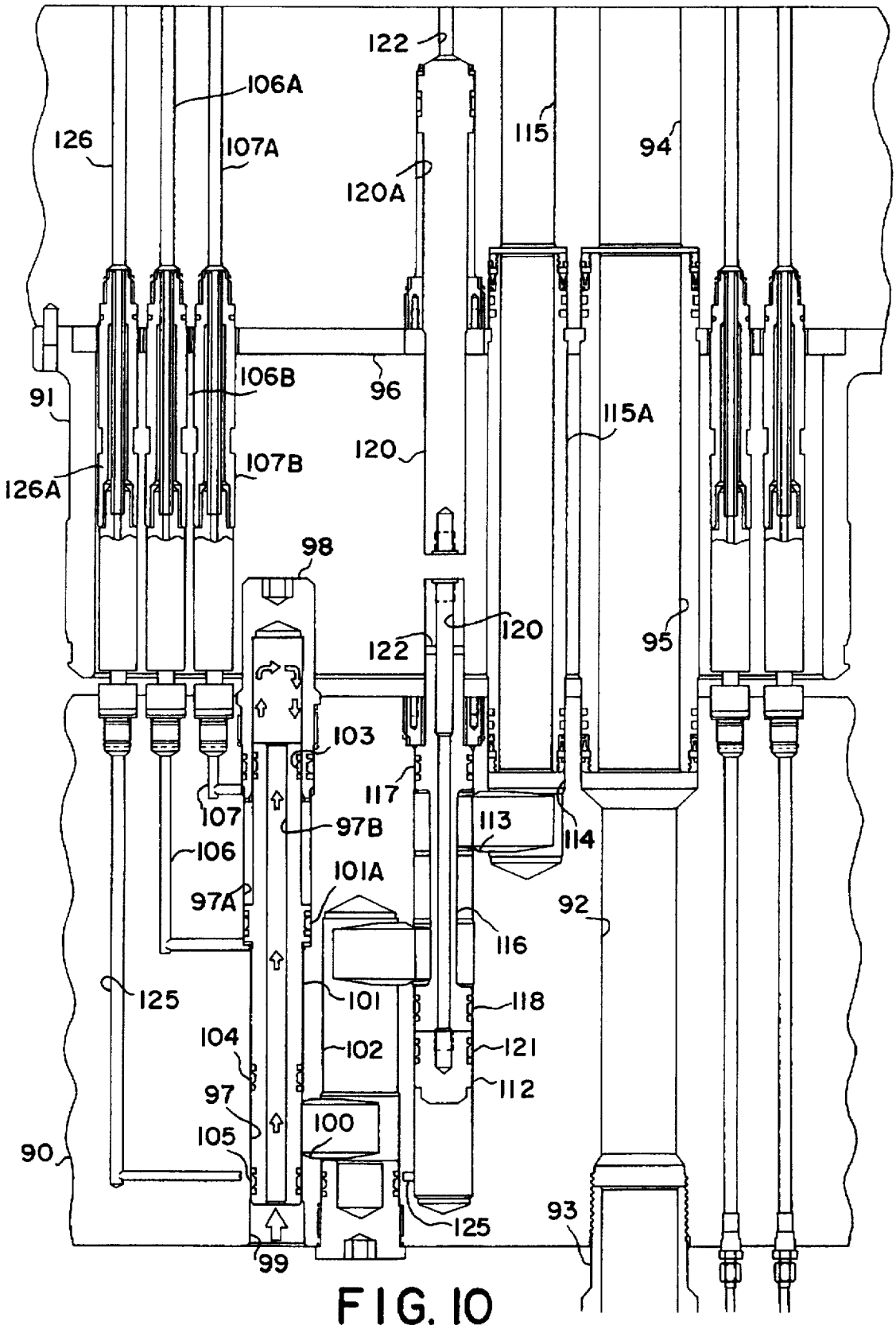
Figure 11:
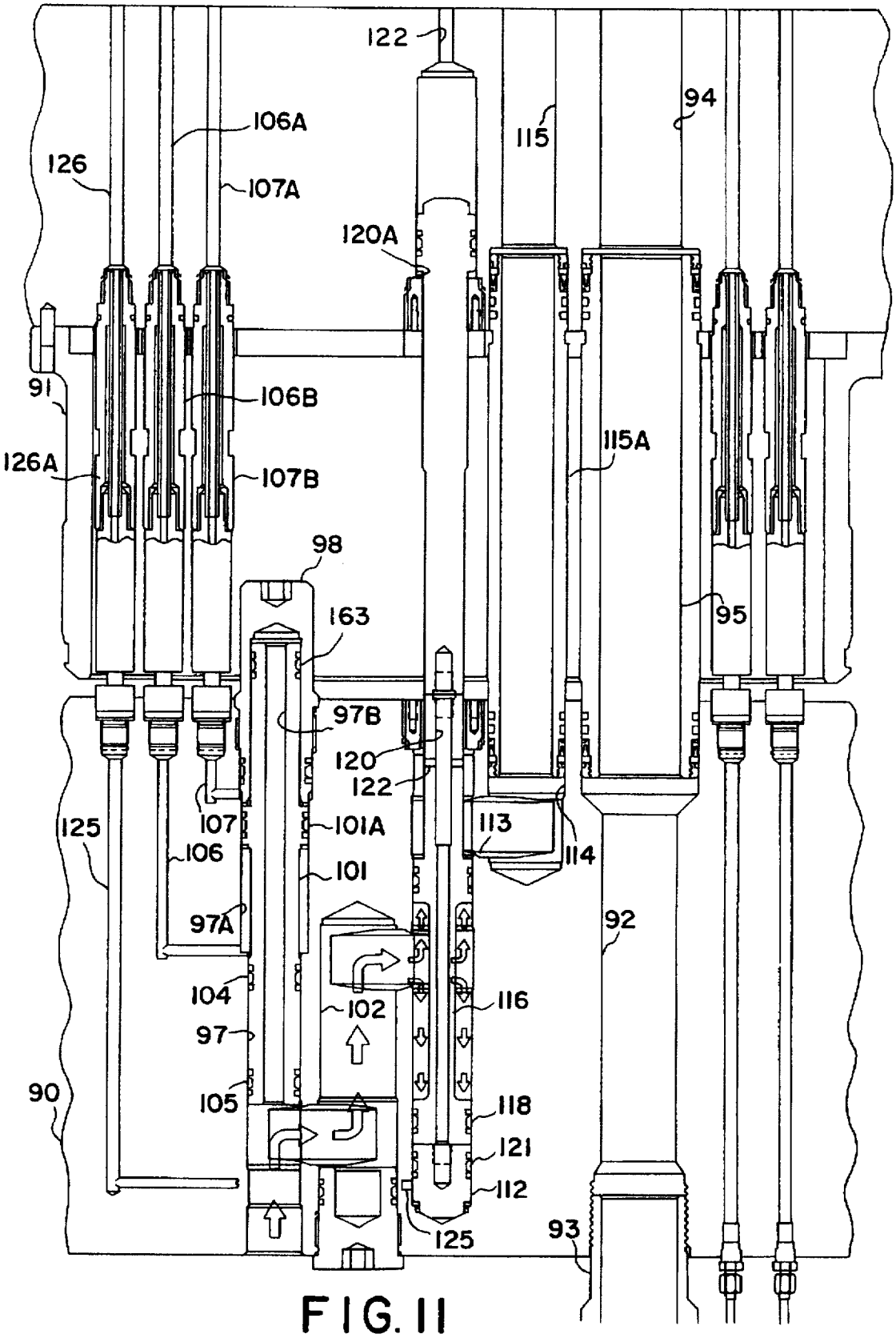
Figure 12:
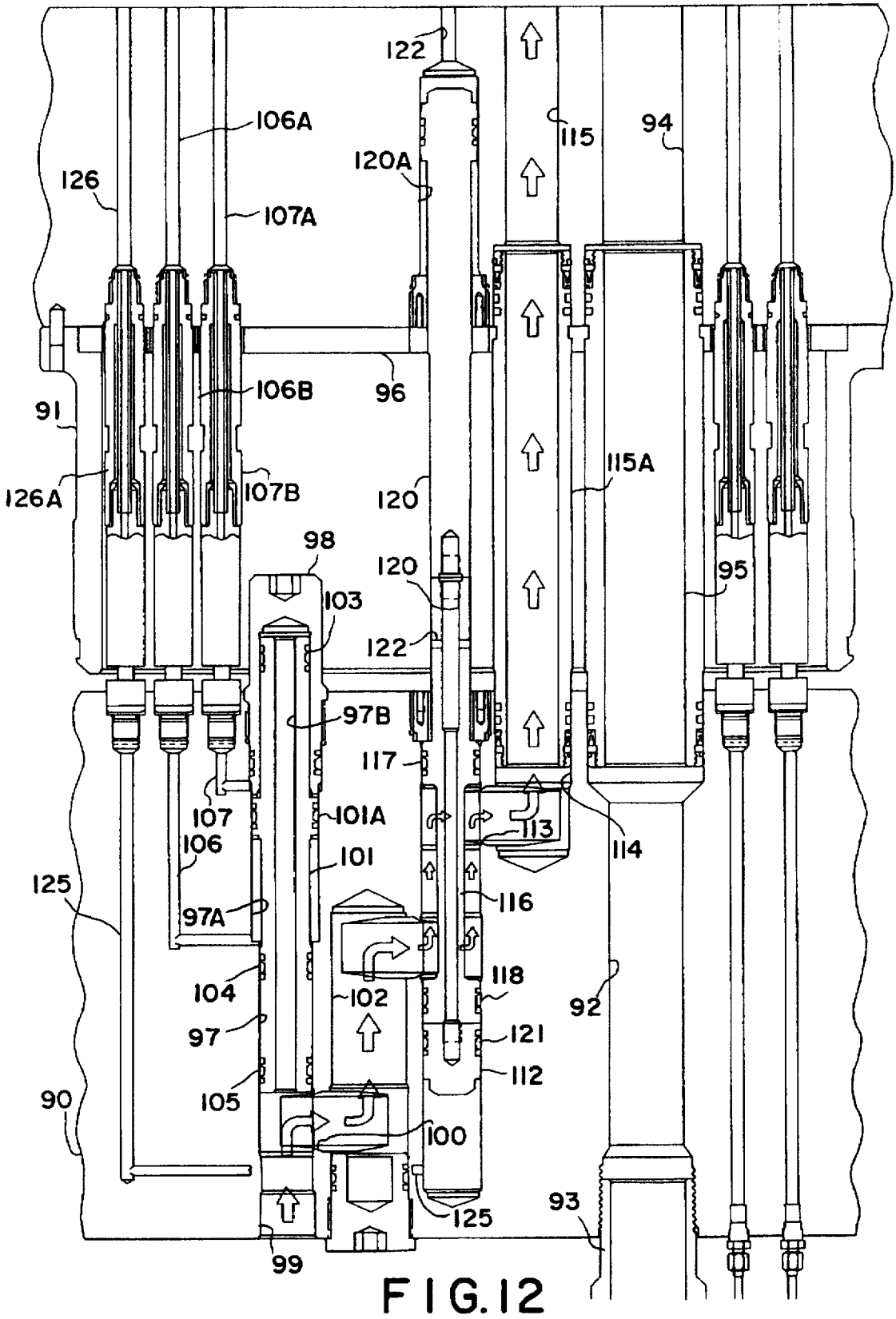
Figure 9:
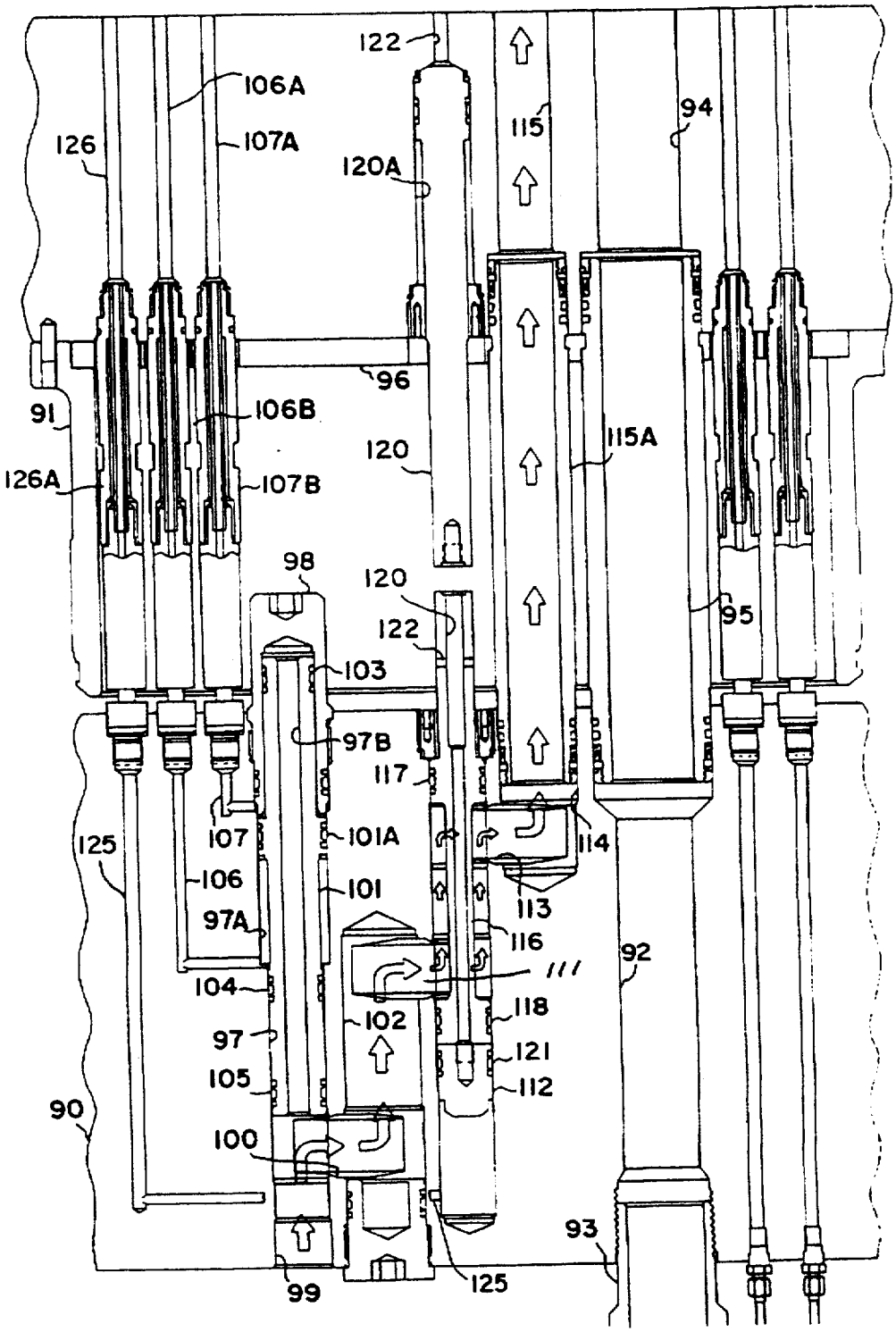
Figure 11:
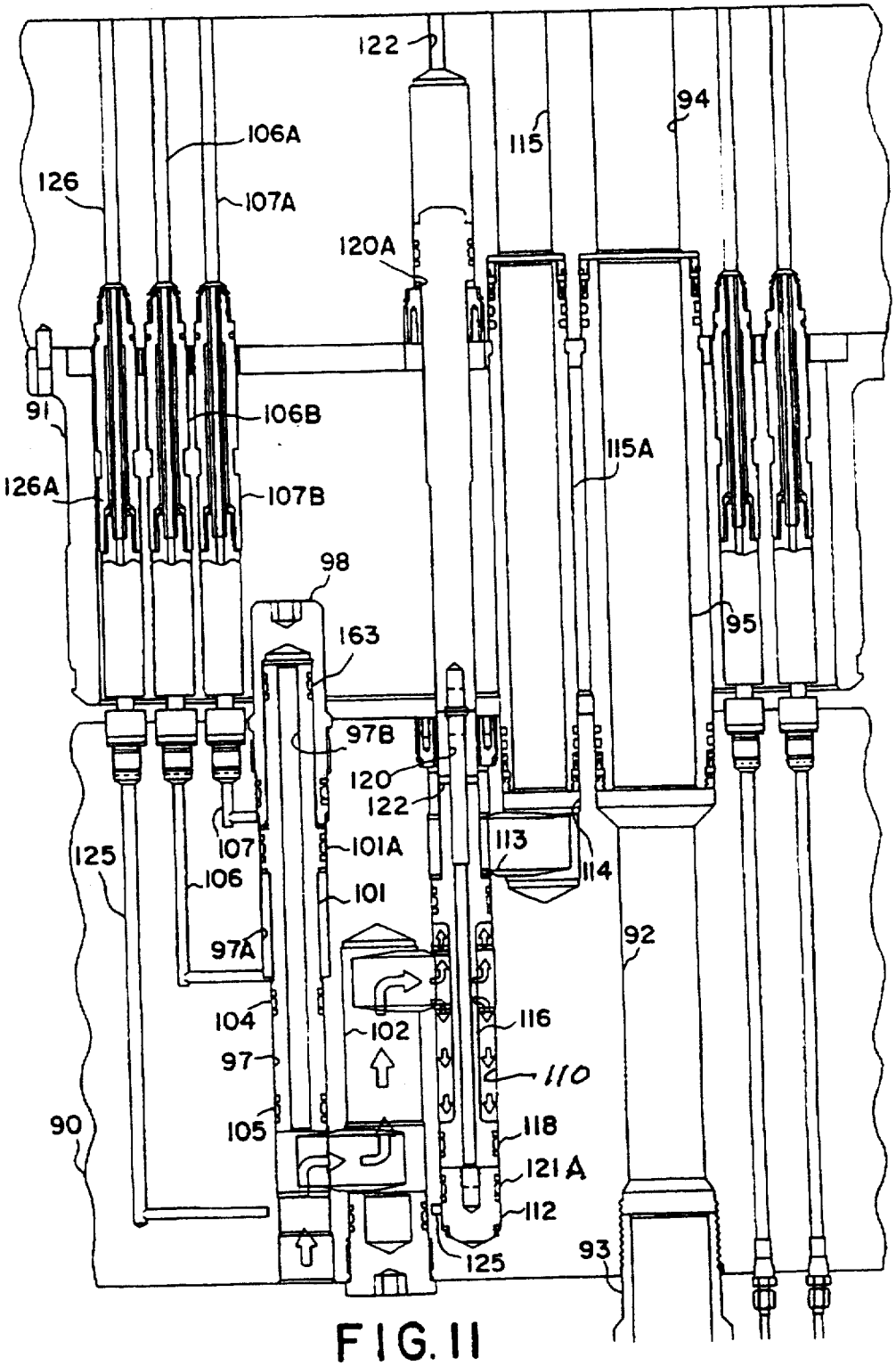

FIG. 8 is a still further cross-sectional view of the tubing hanger, as seen along broken lines 8—8 of FIG. 1, and showing plugs closing the upper ends of the cavities for the first and second valve members as well as the upper end of the upper section of the passageway means at its intersection with a cylindrical recess in the upper end of the hanger in which a lower extension of the Christmas tree is received;

FIG. 9 is a developed vertical sectional view of a subsea wellhead apparatus constructed in accordance with the second embodiment of the invention, including the lower end of a Christmas tree installed above the upper end of a tubing hanger and showing the first and second valve members in open position, as in FIGS. 1 and 2, of the embodiment of FIGS. 1 to 5 to permit flow from the annulus below the hanger to above the hanger and thus into the Christmas tree;

FIG. 10 is a similar view, but with the first valve member moved to closed position to shut off such flow;

FIG. 11 is a view similar to FIG. 10, but with the first valve member open and the second valve member closed in response to pressure from the annulus below the hanger; and FIG. 12 is a view similar to FIG. 11, but with the second valve member open to reestablish flow from the annulus below the hanger to the Christmas tree.

With reference now to the details of the above-described drawings, and particularly the first embodiment of FIGS. 1 to 8, the overall wellhead equipment includes a wellhead housing 10 adapted to be installed in an upright position on the ocean floor and having a bore 11 therethrough connected to the upper end of an outermost casing string (not shown) to form an upward continuation of the well bore and string. A casing hanger 12 is installed within the bore of the housing to suspend an inner casing string (not shown) within the outer string, and an annular space between the outside of the casing hanger and the bore 11 of the wellhead housing is closed off by a seal assembly 12A which may be removably installed and locked in the position shown in any suitable manner, as in the manner shown and described in U.S. Pat. No. 4,757,860, also assigned to the assigned of the present application.

A tubing hanger 13 is also installed in the bore of the wellhead housing and supported on the upper end of the casing hanger to suspend a tubing string 14 therefrom within the inner casing string. The annular space between the tubing hanger and a bore through the casing hanger is closed off by a seal assembly 13A similar to the assembly 12A, and the tubing hanger is held down in supported position by a lock ring 15 held in locking engagement with grooves about the bore of the housing by a wedge 16, installed in a wedge-shaped space between the inside of the lock ring and a tubular extension 17 on the upper end of the tubing hanger.

A Christmas tree 20 is installed on the upper end of the wellhead housing 10 and secured thereto by a lock ring 21 of a suitable connector, such as that shown and described in U.S. Pat. No. 4,497,172, also assigned to the assignee of the present application. As described in such patent, the lock ring is adapted to be wedged radially inwardly in order to preload the flexible lips of a seal ring 22 into sealing engagement with the inner tapered surfaces at the upper end of the wellhead housing bore and the lower end of the Christmas tree.

The tubing hanger has a bore 23 therethrough which forms an upward continuation of the tubing string 14, and the Christmas tree has a central bore 24 therethrough forming an upward continuation of the bore through the tubing hanger. These bores are connected by an intermediate sleeve 25 which is received in enlarged portions of the upper end of the bore through the tubing hanger and the lower end of the bore through the Christmas tree. This sleeve has several passages for connecting ports in the hanger as well as in the tree to pass fluid under pressure to and from suitable locations in the wellhead, all in a manner well known in the art.

The outer diameter of downwardly extending tubular extension 26 forming the enlarged portion of the bore through the Christmas tree extends closely into the upper tubular extension 17 of the tubing hanger. An annular recess 27 extends upwardly from the lower end of the lower tubular extension of the tree, and a seal assembly 29 similar to those above described is disposed between the tubular extensions at the upper end of the tubing hanger and lower end of the Christmas tree. Thus, this seal assembly cooperates with the seal assemblies 12A and 13A to form a fluid barrier across the bore of the wellhead housing.

As shown and described in connection with the annulus valve of the aforementioned U.S. Pat. No. 5,143,158, the passageway means through the tubing hanger includes a lowermost passageway section 40 extending upwardly from the lower end of the tubing hanger and leading to the lower end of an elongate cavity 41 formed in the tubing hanger in axial alignment therewith. A valve member 42 is received in the cavity for vertical reciprocation between an upper position, as shown in FIGS. 1A and 1B, wherein seal rings about its lower end are above a side port 45 connecting the lowermost passageway section with an intermediate vertical section 46 extending parallel thereto, as shown is FIGS. 5 and 6, and a lower position (not shown) in which seal rings on its lower end enter the upper end of section 40 below port 45 to close the connection between the lower passageway section and the side port, thus closing the passageway means through the tubing hanger.

As described in the aforementioned U.S. Pat. No. 5,143,158, the elongate valve member 42 is adapted to be reciprocated between its opened and closed positions by pressure fluid from a remote source, as for example, on or about the Christmas tree. For this purpose, the valve member has an intermediate piston 42A sealably reciprocal within an enlarged annular chamber 41A about the cavity, and carries seal rings 43 and 44 about its upper and lower ends for sealably sliding within the upper and lower portions of the cavity above and below the annular chamber. Seal rings 43 and 44 remain within the cavity in both the opened and closed positions of the valve, while, as above described, the lowermost seals 46 about the valve member move from positions above the side port in the open position of the valve to positions below the side port in the closed position thereof so that the seal rings 44 and 46 bridge the side port and thus close the passageway means. Fluid pressure may be supplied to or exhausted from opposite sides of the piston within the chamber through ports connecting with a suitable remote source, as explained in the above noted patent.

Figure 5:
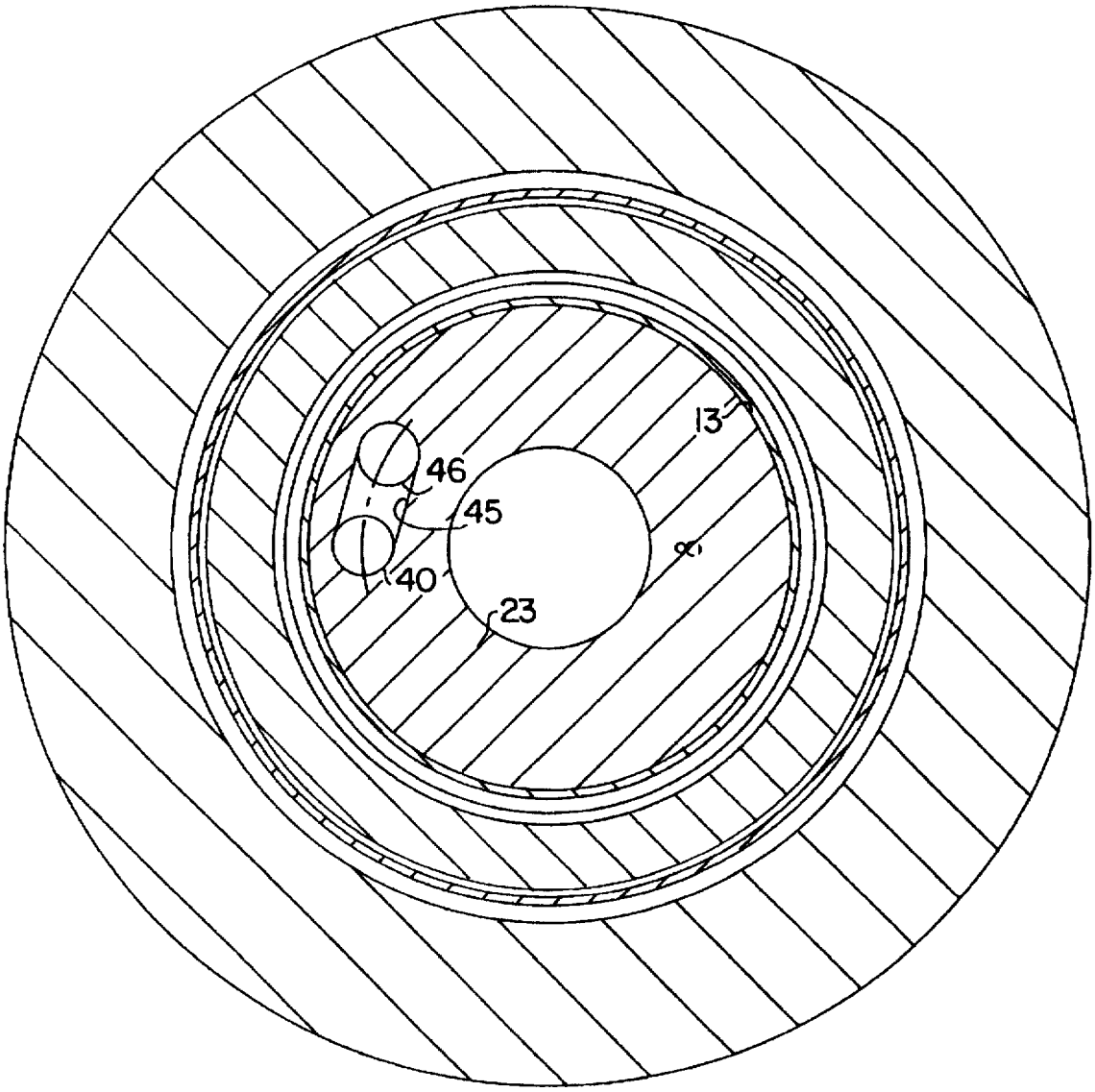
Figure 6:
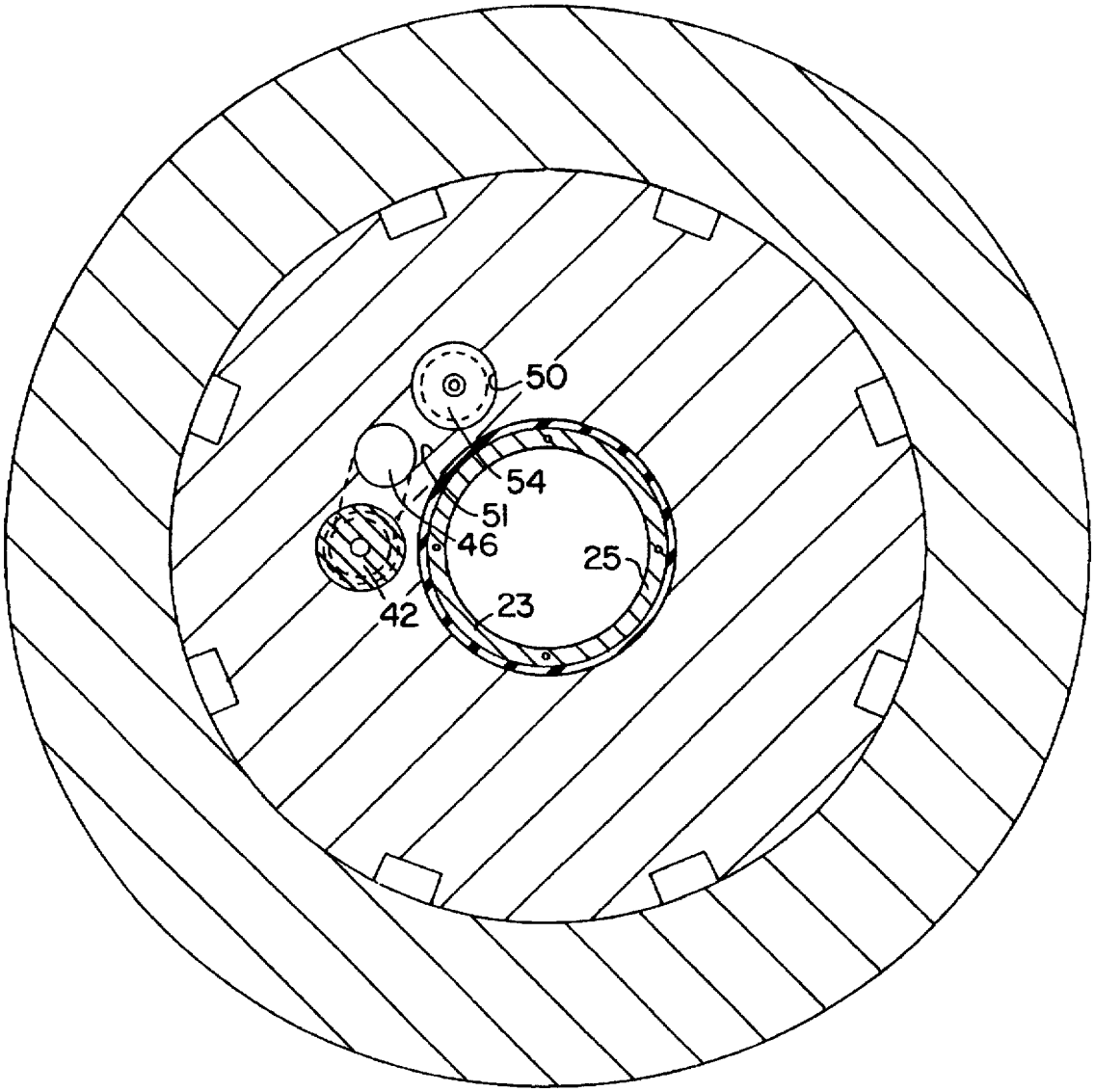
FIG. 6 is another cross-sectional view of an intermediate portion of the tubing hanger, as seen along broken lines 6—6 of FIG. 2, and showing the upper end of the intermediate section of the passageway means connected by a lateral port to an inlet to the cavity in the tubing hanger in which the valve member of the second or shutoff valve reciprocates.
Figure 7:
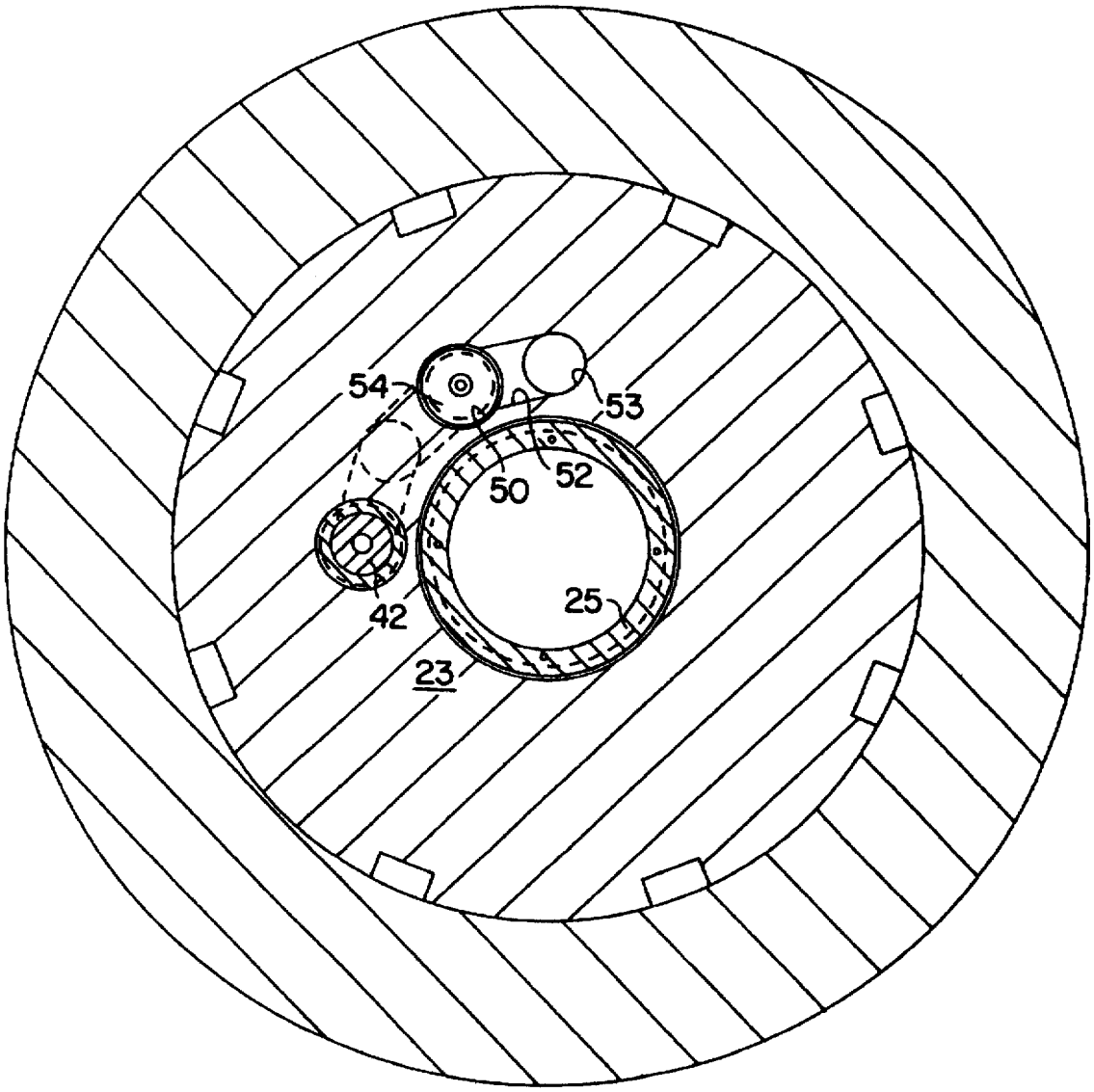
FIG. 7 is still another cross-sectional view of the tubing hanger, as seen along broken lines 7—7 of FIG. 1, and showing an outlet from the upper end of the cavity for the secondary valve connecting with a lateral port leading to an upper section of the passageway means in the tubing hanger connecting with its upper end.

The secondary emergency shutoff valve also includes an elongate vertical cavity 50 extending parallel to the first or main shutoff valve, but oriented rotationally with respect thereto. As shown in FIG. 6, the upper end of the passageway section 46A shown in FIG. 5 is connected to a lower intermediate portion of the cavity 50 by means of a side port 51 (see FIG. 6) to provide an inlet thereto. The upper portion of the cavity is in turn connected through a lateral port 52 to provide an outlet therefrom connecting with an upward section 53 of the passageway means which connects at the upper end with the upward end of the tubing hanger within the recess surrounded by its upper tubular extension, as shown in FIG. 8.

As shown in the drawings, the second valve includes a valve member 54 comprising a spool having a pair of vertically spaced rings 55 and 56 sealably reciprocable in the cavity 50 and connected by a stem 57. In the upper position of the valve member, shown in FIGS. 1 and 2, the upper ring 55 is above the side port 52, and the lower ring is below the lower side port 51, thus forming a connection between lateral ports 51 and 52 and thus the upper and lower vertical sections of the passageway means. However, upon shifting of the valve member downwardly to the position of FIGS. 3 and 4, the upper ring 55 is disposed between the lateral ports 51 and 52, thereby closing the passageway means, as may be desirable upon malfunction of the primary valve upstream of the emergency valve.

The upper end 61 of an enlarged opening about the cavity 41 for the primary valve is closed by a plug 60, so that upon removal of the plug, the valve member 42 may be moved therethrough for repair or replacement. The upper end of the cavity 50 for the second valve is also closed by a plug 62 such that it too may be removed for repair or replacement. The lower side of the plug 62 provides a stop to locate the emergency valve member in its upper open position, as shown in FIGS. 1A and 1B.

Figure 3:
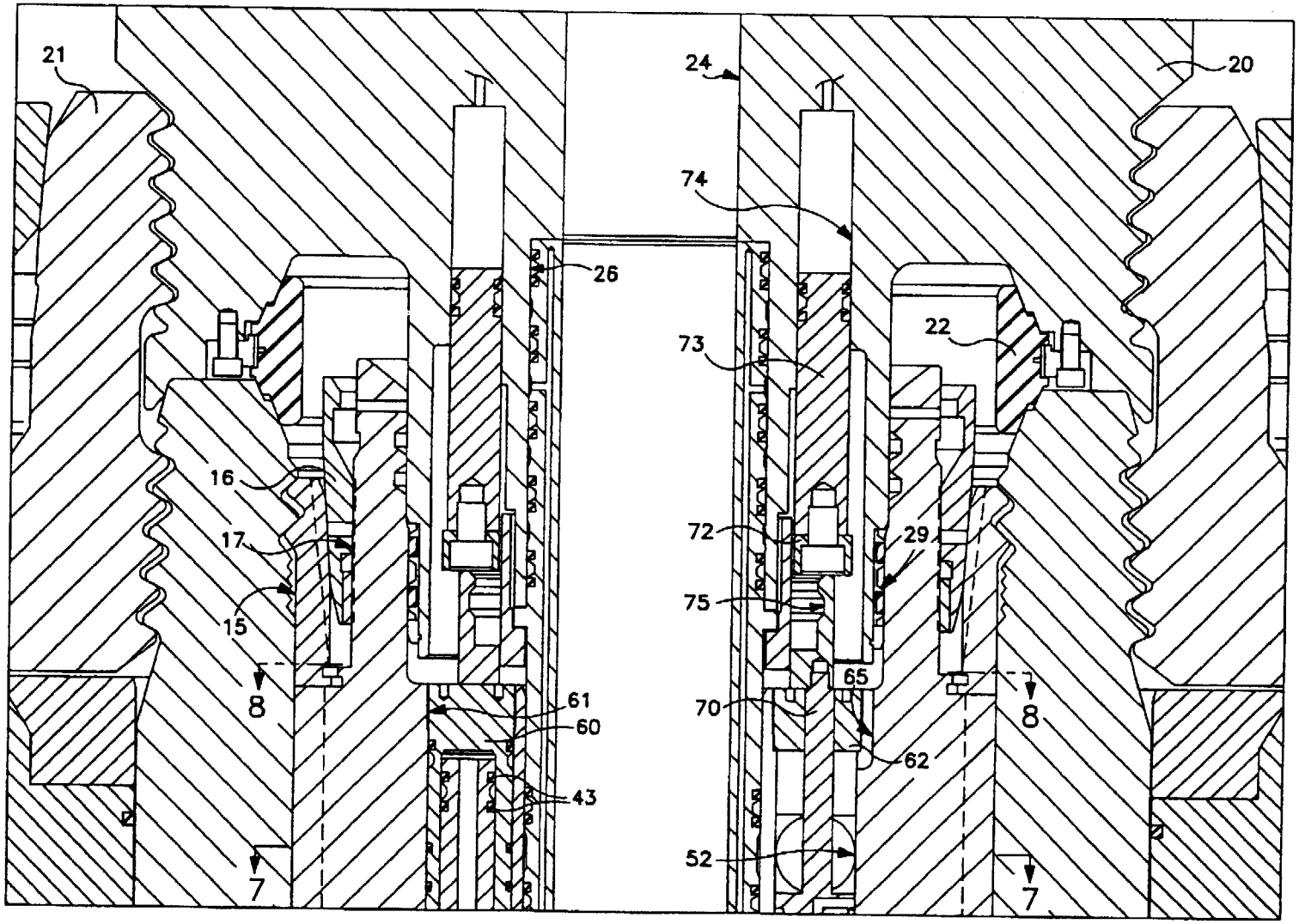
Figure 4:
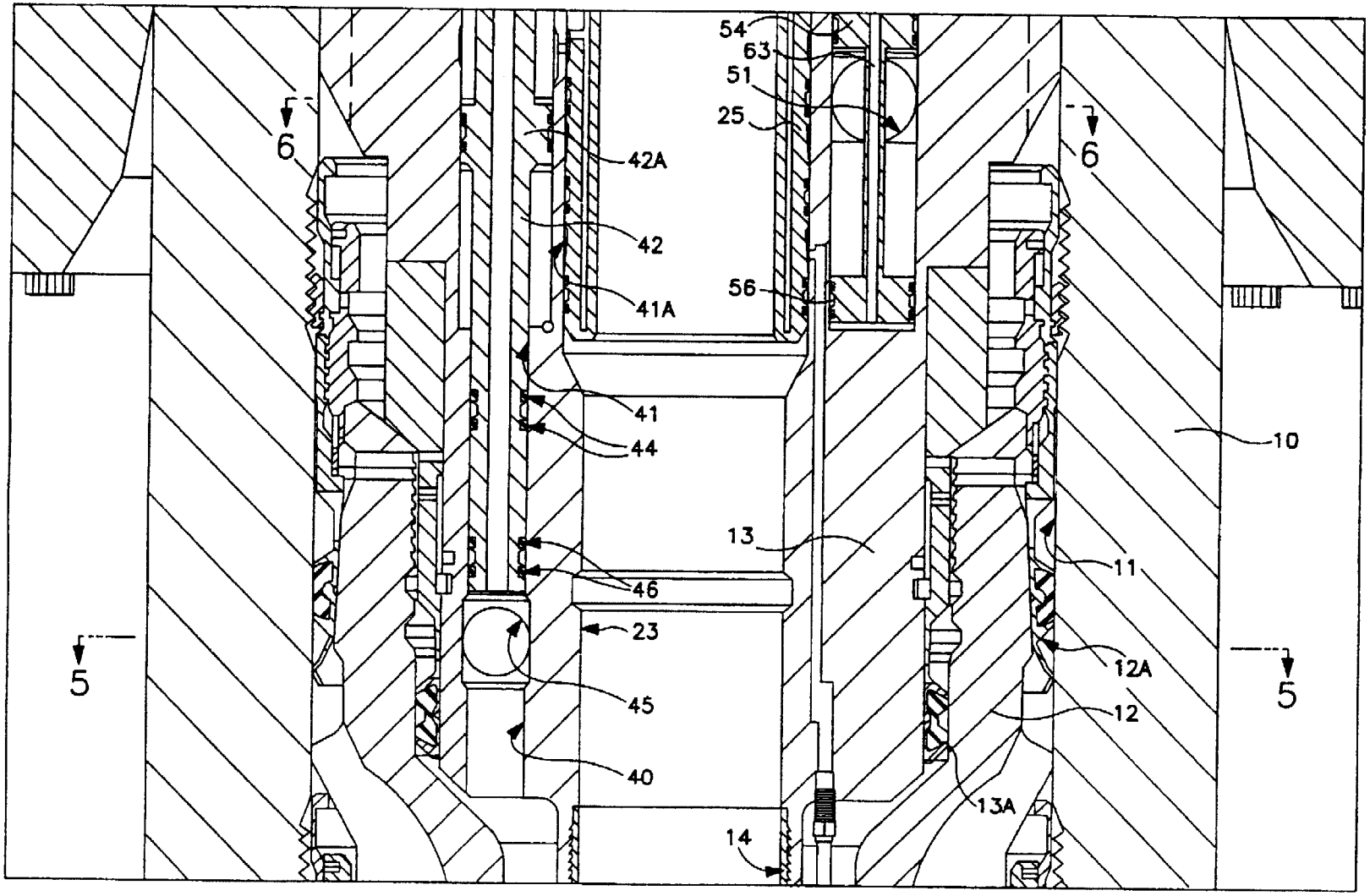

A hole 63 is formed through the stem 57 and rings 54 and 56 of the emergency valve member to connect at its lower end with the lower end of the lower ring and at its upper end with a slot 65 formed in the threaded hole to receive plug 62, as shown in FIGS. 1, 3 and 8, and thus with the recess in the lower tubular extension 26 of the tree in which an upward extension 20A of the passageway means in the Christmas tree 20 is formed for leading to a suitable flow control system in or connected with the tree. More particularly, the cross-sectional areas of the rings are essentially equal so that the valve member is pressure balanced and normally held in its upper position open by frictional engagement of the pistons with the cavity. The pressure balance of the valve member also permits it to be raised upwardly and returned to its open position with a minimum of force.

A rod 70 extends upwardly from the upper end of the upper piston and guidably through a hole 71 in the plug 62 closing the upper end of the cavity and into the annular recess formed within the lower tubular extension of the tree which leads to passageway section 20A in the tree. The upper end of the rod is thus disposed beneath a ring 72 carried within the recess for connection to the lower ends of pistons 73 sealably reciprocal within cylinders 74 formed in the lower end of the recess in the Christmas tree. Thus, upon lowering of the pistons from the upper position shown in broken lines in FIG. 1A to the lower position shown in FIG. 2A, the ring engages and lowers the rod 70, and thus the valve member, downwardly to its closed position.

The ring is bolted to the lower ends of the pistons, and a groove 75 is formed about its inner diameter for access by any suitable tool to permit the emergency valve to be raised to its open position. Like the malfunctioning primary valve member, the second valve member may also be replaced or repaired.

As previously described, the sources of pressure fluid for opening and closing the primary valve and closing the emergency valve, are independent of one another. Such sources may be in or around the Christmas tree or from an remote operated vehicle adapted to be moved into connection with the blowout preventer or the Christmas tree.

As shown in FIGS. 9 to 12, the second embodiment of the subsea wellhead apparatus of the present invention includes a tubing hanger 90 which has been installed in the bore of a wellhead housing and a Christmas tree 91 installed on the wellhead housing above the tubing hanger, as shown and described in connection with the first embodiment. A tubing string 93 is connected to the lower end of a bore 92 through the hanger whose upper end is connected to a bore 94 of the Christmas tree by means of a tubular extension 95 which spans a gap 96 formed in the lower end of the tree.

As in the first embodiment, the tubing hanger has passageway means therethrough connecting the annulus between the tubing and the casing string in which it is suspended with the upper end of the hanger, and, thus, as will be described, with additional passageway means in the Christmas tree during the completion process, whereby flow from the tubing may be controlled in the usual manner within the tree. A first or primary valve installed in the passageway means includes a cavity 97 which has a cap 98 closing its upper end and an open lower end 99 to the annulus below the hanger, and a first valve member 101 vertically reciprocable between positions opening and closing a side port 100 from the cavity and thus flow between the annulus and an intermediate section 102 of the passageway means connecting the first and second valves in series. Thus, when the valve member is raised above the port, as shown in FIGS. 9, 11 and 12, it permits such flow, and, when lowered to close the port, as shown in FIG. 10, prevent such flow.

A piston 101A is formed on the valve member 101 intermediate its upper and lower ends for reciprocating within an enlarged diameter portion 97A of the cavity 97. A seal ring 103 is disposed about the upper end of the valve member to form an upper pressure chamber with the upper side of the piston 101A above it, and a seal ring 104 surrounds a lower portion of the valve member beneath the piston 101A to form a lower pressure chamber between it and the lower side of the piston 103A.

A seal ring 105 also surrounds the lower end of the second valve member beneath the seal ring 104 so that, upon lowering of the valve to the position of FIG. 10, the seal rings 104 and 105 are sealably engaged with the cavity above and below the port to prevent flow. The valve member has a bore 57B therethrough which connects with its upper and lower ends, and the seal rings 103, 104, and 105 are of equal diameter, so that the first valve member 97 is pressure balanced.

The first or primary valve is caused to move between its open and closed position by means of pressure fluid which is selectively supplied to and exhausted to the upper and lower pressure chambers from a remote source. Thus, pressure fluid is adapted to be supplied to the lower pressure chamber through a lower conduit 106 while pressure fluid is exhausted from the upper chamber through a conduit 107, so as to raise the piston and thus the first valve member. Conversely, it may be supplied to the upper chamber through conduit 107 and exhausted through conduit from the lower chamber so as to lower the valve member.

These conduits 106 and 107 in the tubing hanger are in turn connected to conduits 106A and 107A in the Christmas tree by means of tubular connectors 106B and 107B spanning the gap 96. The Christmas tree conduits may of course be connected with suitable valves controlling the supply and exhaust of pressure fluid to and from the remote source or sources, thereby selectively raising or lowering the first valve member to move it between its open and closed positions.

The second or backup valve includes a cavity 110 formed in the passageway means through the tubing hanger parallel to the cavity 97 in which the primary valve member is disposed. This cavity has a side inlet port 111 connecting with the intermediate section 102 of the passageway means above the side port 100, and a side outlet port 113 above the side inlet port 111 and the upper end of the cavity. The side outlet in turn connects with another section 114 of the passageway means leading to the upper end of the tubing hanger and thus with passageway means 115 of the Christmas tree through a tubular extension 115A spanning the gap 96.

The second or backup valve includes a valve member 116 which, as shown, and as was true of the first embodiment, is a spool having an upper piston 117 as well as a lower piston 118 about its reduced outer diameter portion above an auxiliary piston 121. As in the case of the first valve, the spool has a bore 120 connecting its lower end with side ports 122 adjacent its upper end above piston 117 so as to pressure balance the second valve member.

In the open position of the second valve member, shown in FIGS. 9, 11 and 12, the piston 117 is above the outlet port 113 and the piston 118 is below the side inlet 111, so as to permit flow within the cavity between the sections 102 and 114 of the passageway means about the reduced diameter of the spool. In the closed position of the second valve, as shown in FIG. 11, the upper piston 117 is disposed within the cavity 110 intermediate side inlet 111 and side outlet 113 so as to prevent flow between the sections 102 and 114 of the passageway means.

The second valve member is adapted to be moved from its upper, open position of FIGS. 9, 11 and 12 to its lower, closed position of FIG. 11 by means of a piston 120 vertically reciprocal within a cavity 120A opening to the lower end of the Christmas tree with a tubular extension on its lower end rotationally aligned with an upper end of second valve member 116 extending through hole in the hanger above cavity 110. The fluid may be supplied from a suitable source to the upper end of the cavity 120A above piston 120 through a conduit 122 in the preventer so as to lower the piston to engage the upper end of the second valve member and move it downwardly to its closed position of FIG. 11.

An auxiliary piston 121 is disposed in the chamber 110 below the lower piston 118 on the second valve member so as to form a stop to downward movement of the second valve member to the closed position of FIG. 11, and, when raised, to lift the second valve member to its upper, open position, as shown in FIG. 12. Thus, pressure fluid may be supplied to the lower end of the cavity 120 beneath seal ring 121A about the auxiliary piston 121 so as to move it upwardly 25 pressure fluid is exhausted through the conduit 122.

This pressure fluid is supplied to the lower end of the piston 121 by means of a conduit 125 connecting with the cavity 110 beneath the seal ring 121 of the piston 121. The upper end of the conduit 125 is in turn connected to a conduit 126 in the Christmas tree by means of a tubular extension 126A spanning the gap 96. The pressure fluid may be selectively exhausted from the cavity 110 in order to permit the auxiliary piston 121 to be lowered from the position of FIG. 12 back to the position of FIG. 11, upon lowering of the piston 120 as shown in FIG. 11. Then of course, the second valve member may again be raised to its open position by the supply of pressure fluid through conduit 125.

As in the first embodiment of the invention, the first and second valves are adapted to be operated independently of one another. Consequently, during normal conditions, there may be no need to operate the second or backup valve. Thus, it may remain in its open position, as shown in FIGS. 9 and 10, to permit the flow through the passageway means in the tubing hanger to be controlled by the first valve.

However, as in the first embodiment, in the event of a malfunction of some type of the first valve, the passageway means in the tubing hanger may nevertheless be closed by moving of the second valve member to the closed position of FIG. 11. Then, when it is desired to resume flow through the passageway means in the tubing hanger, the second valve member may be moved from the closed position of FIG. 11 to the open position of FIG. 12, thus enabling flow through the passageway means to be again controlled by the first or primary valve. As compared with the first embodiment of the invention, the second valve may be moved from its closed to its open position hydraulically, and thus without the necessity of first removing the blowout preventer in order to enable the upper end of the second valve member to be grasp and lifted from its closed to its position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A subsea wellhead, comprising a wellhead housing adapted to be installed at the head of a well bore to suspend a casing string therefrom and having a bore therethrough, a tubing hanger supported within the bore of the housing to suspend a tubing string within the casing string, and having passageway means connecting the annulus between the casing and tubing strings beneath the tubing hanger with its upper end, a first valve including a first valve member in the passageway means, means for selectively moving said first valve member between opened and closed position, a second valve including a second valve member in the passageway means in series with the first valve member, and means for moving said second valve member from a normally open to a closed position independently of operation of the first valve member.

2. A subsea wellhead, comprising a wellhead housing adapted to be installed at the head of a well bore to suspend a casing string therefrom and having a bore therethrough, a tubing hanger supported within the bore of the housing to suspend a tubing string within the casing string, and having first passageway means connecting the annulus between the casing and tubing strings beneath the tubing hanger with its upper end, a Christmas tree removably mounted on the housing above the upper end of the tubing hanger and having second passageway means forming a continuation of the upper end of the first passageway means, a first valve including a first valve member in the first passageway means, means for selectively moving said first valve member between opened and closed position, a second valve including a second valve member in the first passageway means in series with the first valve member, and means for moving said second valve member from a normally open to a closed position independently of operation of the first valve member.

3. A wellhead of the character defined in claim 2, wherein said means for moving the first valve member is responsive to a remote source of fluid under pressure.

4. A wellhead of the character defined in claim 3, wherein said fluid pressure is supplied to the moving means through the Christmas tree.

5. A wellhead of the character defined in claim 2, wherein said means for moving the second valve member is responsive to a remote source of fluid under pressure.

6. A wellhead of the character defined in claim 5, wherein said fluid pressure is supplied to the moving means through the Christmas tree.

7. A wellhead of the character defined in claim 2, wherein the means for moving each of the first and second valve members is responsive to a remote source of fluid under pressure.

8. A wellhead of the character defined in claim 7, wherein the fluid pressure is supplied to each moving means through the Christmas tree.

9. A wellhead of the character defined in claim 2, wherein the first passageway means includes an elongate cavity having a closed end, a side inlet and a side outlet, said second valve member includes a spool sealably shiftable longitudinally within the cavity between open and closed positions respectively connecting and disconnecting the inlet and outlet, and the spool has a hole therethrough to balance forces due to fluid pressure on its opposite ends.

10. A wellhead of the character defined in claim 9, wherein the means for moving the second valve member, includes a stem extending through the end of the cavity, opposite its closed end, and a piston reciprocable in the Christmas tree and responsive to fluid pressure from a remote source to urge it against the stem and thus move the second valve member from open to closed position.

11. A wellhead of the character defined in claim 10, wherein the stem has means thereon which, upon removal of the Christmas tree, may be grasped from above the tubing hanger in order to move the second valve member back to open position.

12. A wellhead of the character defined in claim 10, including a piston having a seal ring thereabout reciprocable in the cavity intermediate its closed end and the spool, and means for selectively supplying fluid pressure from a remote source or cavity intermediate the seal ring and closed end of the cavity to move the second valve member from closed to open position, and venting said fluid pressure from the cavity to permit the second valve member to be moved from opened to closed position.

13. A tubing hanger for use in a subsea wellhead housing having a bore therethrough and a casing hanger supported within the bore of the housing to suspend a casing string therefrom, comprising a tubular body having a bore therethrough and adapted to be landed within the bore of the housing to suspend a tubing string connected to its bore within the casing string and having passageway means which, upon landing of the tubular body, connects the annulus between the casing and tubing strings with the upper end of the tubing hanger, a first valve including a first valve member installed in the passageway means in the hanger body, means for selectively moving the first valve member between opened and closed positions, a second valve including a second valve member installed in the passageway means in the hanger body in series with the first valve member, and means for moving said second valve member from a normally open to a closed position independently of operation of the first valve member.

14. A tubing hanger for use in a subsea wellhead housing having a bore therethrough and a casing hanger supported within the bore of the housing to suspend a casing string therefrom, comprising a tubular body having a bore therethrough and adapted to be landed within the bore of the housing to suspend a tubing string connected to its bore within the casing string and having first passageway means which, upon landing of the tubular body, connects the annulus between the casing and tubing strings with the upper end of the tubing hanger and thus with second passageway means in a Christmas tree adapted to be removably mounted on the wellhead housing above the tubing hanger, a first valve including a first valve member in the first passageway means, means thereon for selectively moving the first valve member between opened and closed positions, a second valve including a second valve member installed in the first passageway means in series with the first valve member, and means for moving said second valve member from a normally open to a closed position independently of operation of the first valve member.

15. A tubing hanger of the character defined in claim 14, wherein said means for moving the first valve member is responsive to a remote source of fluid under pressure.

16. A tubing hanger of the character defined in claim 15, wherein said fluid pressure is supplied to the moving means through the Christmas tree.

17. A tubing hanger of the character defined in claim 14, wherein said means for moving the second valve member is responsive to a remote source of fluid under pressure.

18. A tubing hanger of the character defined in claim 17, wherein said fluid pressure is supplied to the moving means through the Christmas tree.

19. A tubing hanger of the character defined in claim 14, wherein the means for moving each of the first and second valve members is responsive to a remote source of fluid under pressure.

20. A tubing hanger of the character defined in claim 19, wherein the fluid pressure is supplied to each moving means through the Christmas tree.

21. A tubing hanger of the character defined in claim 14, wherein the first passageway means includes an elongate cavity having a closed end, a side inlet and a side outlet, said second valve member includes a spool sealably shiftable longitudinally within the cavity between open and closed positions respectively connecting and disconnecting the inlet and outlet, and the spool has a hole therethrough to balance forces due to fluid pressure on its opposite ends.

22. A tubing hanger of the character defined in claim 21, wherein the means for moving the second valve member includes a stem extending through the end of the cavity opposite its closed end in position to be engaged by a piston reciprocable in the Christmas tree in response to fluid pressure from a remote source and thus move the second valve member from open to closed position.

23. A tubing hanger of the character defined in claim 22, wherein the stem has means thereon which, upon removal of the Christmas tree, may be grasped from above the tubing hanger in order to move the second valve member back to open position.

24. A wellhead of the character defined in claim 22, including a piston having a seal ring thereabout reciprocable in the cavity intermediate its closed end and the spool, means through which fluid pressure may be from a remote source intermediate the seal ring and closed end of the cavity to move the second valve member from closed to open position, and from which said fluid pressure may be from the cavity to permit the second valve member to be moved from opened to closed position.

* * * * *

UNITED STATES PATENT AND TRADEMARK OFFICE

CERTIFICATE OF CORRECTION

PATENT NO. : 5,687,794

DATED : November 18, 1997

INVENTOR(S) : Bruce J. Watkins
Larry E. Reimert

It is certified that error appears in the above-indentified patent and that said Letters Patent is hereby corrected as shown below:

In the Abstract, line 4, before "upper" cancel —to the—

Col. 2, line 26, change "stock" to --stack--;
Col. 2, line 50, cancel "may";
Col. 2, line 50, after "thereabout" insert --is--;
Col. 2, line 51, after "means" insert --are provided--;
Col. 2, line 55, cancel the comma;
Col. 3, line 5, before "Figs." insert --of--;
Col. 3, line 42, change "5" to --8--;
Col. 3, line 66, change "assigned" to --assignee--;
Col. 4, line 67, change "reciprocal" to --reciprocable--;
Col. 6, line 6, change "reciprocal" to --reciprocable--;
Col. 6, line 21, change "an" to --a--;
Col. 7, line 6, after "exhausted" change "to" to --from--;
Col. 7, line 12, after "conduit" (2nd occurrence) insert —106—
Col. 7, line 56, change "reciprocal" to --reciprocable--;
Col. 8, line 5, change "120" to --110--;
Col. 8, line 7, change "25" to --as--;
Col. 8, line 11, after "seal ring" change "121" to --121A--;
Col. 8, line 41, change "grasp" to --grasped--;
Col. 8, line 42, before "position" insert --open--.

UNITED STATES PATENT AND TRADEMARK OFFICE

CERTIFICATE OF CORRECTION

PATENT NO. : 5,687,794

DATED : November 18, 1997

INVENTOR(S) : Bruce J. Watkins
Larry E. Reimert

It is certified that error appears in the above-identified patent and that said Letters Patent is hereby corrected as shown below:

In the Drawings:

FIG. 9, add reference character 111; as shown on the attached page.

FIG. 11, add reference character 110; as shown on the attached page.

FIG. 11, change reference character "121" to --121A--.

Signed and Sealed this

Twenty-first Day of April, 1998

Bruce Lehman

*Attest:*

BRUCE LEHMAN

*Attesting Officer*

*Commissioner of Patents and Trademarks*